US005417097A

United States Patent [19]

Kojima et al.

[11] Patent Number: 5,417,097

[45] Date of Patent: May 23, 1995

[54] PROCESS AND APPARATUS FOR PRESS FORMING

[75] Inventors: Ichirou Kojima, Ichinomiya; Terumi Nishida, Aichi; Kunio Yamada, Anjo, all of Japan

[73] Assignee: Nippondenso Co., Ltd., Kariya, Japan

[21] Appl. No.: 120,836

[22] Filed: Sep. 15, 1993

[30] Foreign Application Priority Data

Sep. 17, 1992 [JP] Japan ..... 4-248166

[51] Int. Cl.[6] ..... B21D 28/02; B21D 53/04

[52] U.S. Cl. ..... 72/335; 72/339; 72/404; 72/442

[58] Field of Search ..... 72/334–339, 72/330, 331, 404, 442, 444

[56] References Cited

U.S. PATENT DOCUMENTS

| | | | |
|---|---|---|---|
| 1,113,442 | 10/1914 | Irvin | 72/442 |
| 1,302,870 | 5/1919 | Spery | 72/331 |
| 1,657,449 | 1/1928 | Amsden | 72/337 |
| 1,942,353 | 1/1934 | Berger | 72/338 |
| 1,994,428 | 3/1935 | Keil | 72/331 |
| 2,614,515 | 10/1952 | Wheeler | 72/336 |
| 4,125,080 | 11/1978 | Moller | 72/337 |
| 5,119,666 | 6/1992 | Fujiwara | 72/442 |
| 5,271,140 | 12/1993 | Futamura | 72/442 |

FOREIGN PATENT DOCUMENTS

| | | | |
|---|---|---|---|
| 3807075 | 9/1989 | Germany | 72/442 |
| 3935498 | 5/1991 | Germany | 72/442 |
| 61927 | 4/1983 | Japan | 72/337 |

OTHER PUBLICATIONS

Yasusada Yonemura, "Jitsurei Puresu Kako To Katasekkei No Kaizen", Nikkan Kogyo Shimbunsha, Feb. 28, 1969, pp. 1–4, 128 & 221.

*Primary Examiner*—Daniel C. Crane

*Attorney, Agent, or Firm*—Cushman, Darby & Cushman

[57] ABSTRACT

A process of press-forming a strip fed in its longitudinal direction to continuously produce press-formed articles with arbitrary lengths through forming stages including a draw-forming stage, the process comprising the steps of: a first step of continuously forming a semi-finished product having a middle portion formed over a length corresponding to that of a final product and an unformed leading end connected to an unformed following end of a neighboring antecedent semi-finished product, while feeding a strip in the direction of the strip length at a selected pitch; a second step of simultaneously draw-forming the unformed leading end of the semi-finished product and the unformed following end of the neighboring antecedent semi-finished product to a selected shape, the ends being connected to the respective semi-finished products; and a third step of separating scrap from peripheries of the leading end of the semi-finished product and the following end of the neighboring antecedent semi-finished product. An apparatus for carrying out the process is also disclosed.

10 Claims, 11 Drawing Sheets

PROCESS AND APPARATUS FOR PRESS FORMING

BACKGROUND OF THE INVENTION

1. Field of the Invention

The present invention relates to a process and an apparatus for press-forming strips.

2. Description of the Related Art

Known articles press-formed from strips are represented, for example, by a sheet metal having a shallow draw-formed brim on the periphery and a plurality of evenly spaced holes inside for supporting tubes in the heater core of an automobile heater.

FIG. 1 shows a known press forming process for producing the sheet metal by a "transfer press forming". In a press forming line composed by arranging a plurality of press machines each having a pair of die and punch, a sheet is trimmed in the first press machine to a blank with a required size and shape, the blank is then transferred to the second press machine for drawforming, further transferred to the third press machine for piercing holes through the sheet thickness, and finally transferred to the fourth machine for burring the holes to complete a product sheet metal.

Also known is "progressive press forming" as reviewed by Yasusada Yonemura in "Jitsurei Puresukako To Katasekkei No Kaizen (Practical Press Forming and Improved Die Designing)" published from Nikkan Kogyo Shimbun Sha (Daily Industry News), Feb. 28, 1969. A strip is fed through "progressive dies" arranged in series for several press forming steps in a single press machine, to continuously produce press-formed products with the same shape.

The transfer press forming process, however, has a problem that a minor change of design of a product, such as the length or other dimensions, necessitates changing dies for the respective press forming steps, increasing the cost of die preparation and requiring additional setup time for the die change.

The progressive press forming process also has a problem that the die arrangement including component dies for several press forming steps has a complicated structure, so that a change of design in the number of holes to be pierced or in the length of a product necessitates changing component dies as a whole, increasing the cost of die preparation and requiring additional setup time for the die change.

SUMMARY OF THE INVENTION

The object of the present invention is to provide a press forming process and an apparatus for carrying out the process, in which no die change is necessary to change the product dimension and number of holes.

To achieve the object according to the present invention, there is provided a process of press-forming a strip fed in its longitudinal direction to continuously produce press-formed articles with arbitrary lengths through forming stages including a draw-forming stage, the process comprising the steps of:

a first step of continuously forming a semi-finished product having a middle portion formed over a length corresponding to that of a final product and an unformed leading end connected to an unformed following end of a neighboring antecedent semi-finished product, while feeding a strip in the direction of the strip length at a selected pitch;

a second step of simultaneously draw-forming the unformed leading end of the semi-finished product and the unformed following end of the neighboring antecedent semi-finished product to a selected shape, the ends being connected to the respective semi-finished products; and a third step of separating scrap from the peripheries of the leading end of the semi-finished product and the following end of the neighboring antecedent semi-finished product.

The present invention also provides an apparatus for press-forming a strip fed in its longitudinal direction to continuously produce press-formed articles with arbitrary lengths through forming stages including a draw-forming stage, the apparatus comprising:

a means for feeding a strip in the direction of the strip length at a selected pitch;

a first press-forming means for continuously forming a semi-finished product having a middle portion formed over a length corresponding to that of a final product and an unformed leading end connected to an unformed following end of a neighboring antecedent semi-finished product, while feeding a strip in the direction of the strip length at a selected pitch;

a second press-forming means for simultaneously draw-forming the unformed leading end of the semi-finished product and the unformed following end of the neighboring antecedent semi-finished product to a selected shape, the ends being connected to the respective semi-finished products; and a third press-forming means for separating scrap from peripheries of the leading end of the semi-finished product and the following end of the neighboring antecedent semi-finished product.

In a preferred embodiment of the present invention, the second press-forming means and the third press-forming means may compose a fourth single press-forming means for effecting the draw-forming and the separating.

Typically, the first press-forming means and the fourth press-forming means have individual intermittent motion mechanisms to intermit their press-forming motions for arbitrary time intervals, respectively, so that, by intermitting the press-forming motions at arbitrary pitches, the middle portion of the strip is press-formed over a length corresponding to the pitch and, corresponding to the pitch, the unformed leading and following ends of the semi-finished products are draw-formed to a selected shape connected to the middle portion and separated to form a final product with an arbitrary length.

Preferably, the first press-forming means includes a pilot means for accurately positioning the strip by utilizing the portions press-formed by the first press-forming means so that the middle portion of the strip is press-formed at a selected pitch.

Preferably, the fourth press-forming means includes a pilot means for accurately positioning the strip by utilizing the portions press-formed by the first press-forming means so that the drawing and the separation are effected by the fourth press-forming means at a selected pitch.

According to another aspect of the present invention, there is provided an apparatus for press-forming a strip fed in its longitudinal direction to continuously produce press-formed articles with arbitrary lengths through forming stages including a draw-forming stage, the apparatus comprising:

an upper table on which are provided a plurality of press-forming means including a first press-forming means for continuously forming a semi-finished product having a middle portion formed over a length corresponding to that of a final product and an unformed leading end connected to an unformed following end of a neighboring antecedent semi-finished product, while feeding a strip in the direction of the strip length at a selected pitch; and disposed downstream of the first press-forming means, a second press-forming means for simultaneously draw-forming the unformed leading end of the semi-finished product and the unformed following end of the neighboring antecedent semi-finished product to a selected shape, the ends being connected to the respective semi-finished products; and a lower table on which are provided press-forming means corresponding to and engageable with the press-forming means on the upper table;

a means for feeding the strip between the upper table and the lower table at a selected feeding pitch; and a drive means for raising and lowering the upper table interlocking with the feeding pitch to effect press-formings by the engagement between press-forming means on the upper and lower tables as the upper table is lowered, so as to repeat a cycle composed of the phases of feeding the strip by one pitch when the upper table is raised and effecting the press-formings when the upper table is lowered.

Typically, the plurality of press-forming means have individual intermittent motion mechanisms to intermit their press-forming motions for arbitrary time intervals, respectively, so that, by intermitting the press-forming motions at arbitrary pitches, the middle portion of the strip is press-formed over a length corresponding to the pitch and, corresponding to the pitch, the unformed leading and following ends of the semi-finished products are draw-formed to a selected shape connected to the middle portion and separated to form a final product with an arbitrary length.

Preferably, the plurality of press-forming means include a pilot means for accurately positioning the strip by utilizing the portions press-formed by the first press-forming means so that the middle portion of the strip is press-formed at a selected pitch.

Usually, the plurality of press-forming means are dies or punches.

Preferably, the upper and lower tables are provided with a means for separating scrap from the peripheries of the leading end of the semi-finished product and the following end of the antecedent semi-finished product.

DESCRIPTION OF THE PREFERRED EMBODIMENTS

Figure 1:
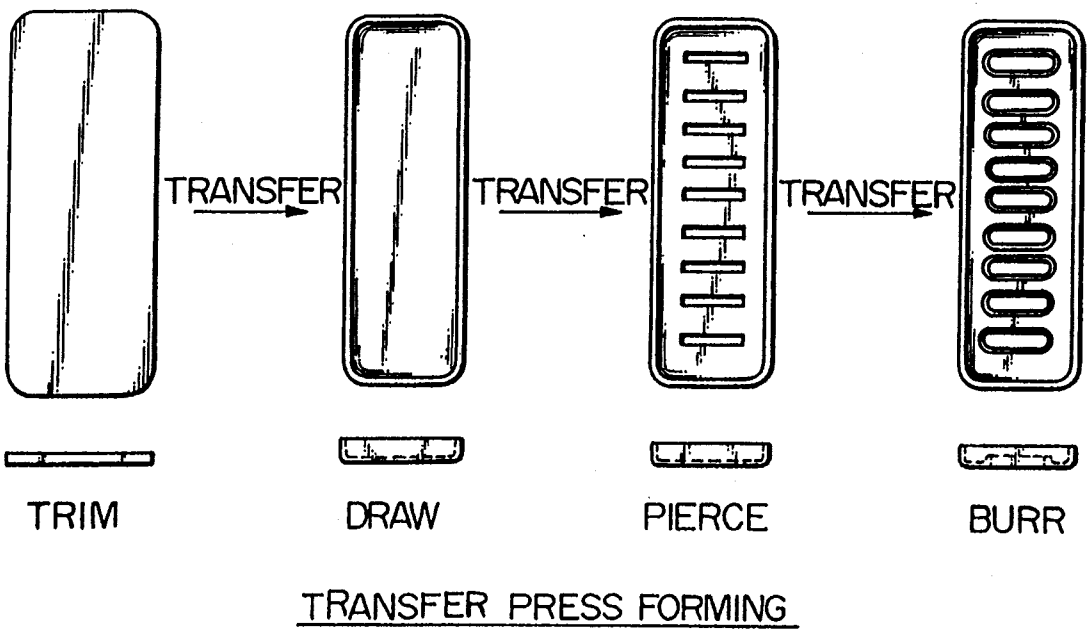
Fig. 1 PRIOR ART
FIG. 1 shows a known press forming process for producing the sheet metal by a "transfer press forming"
Figure 2:
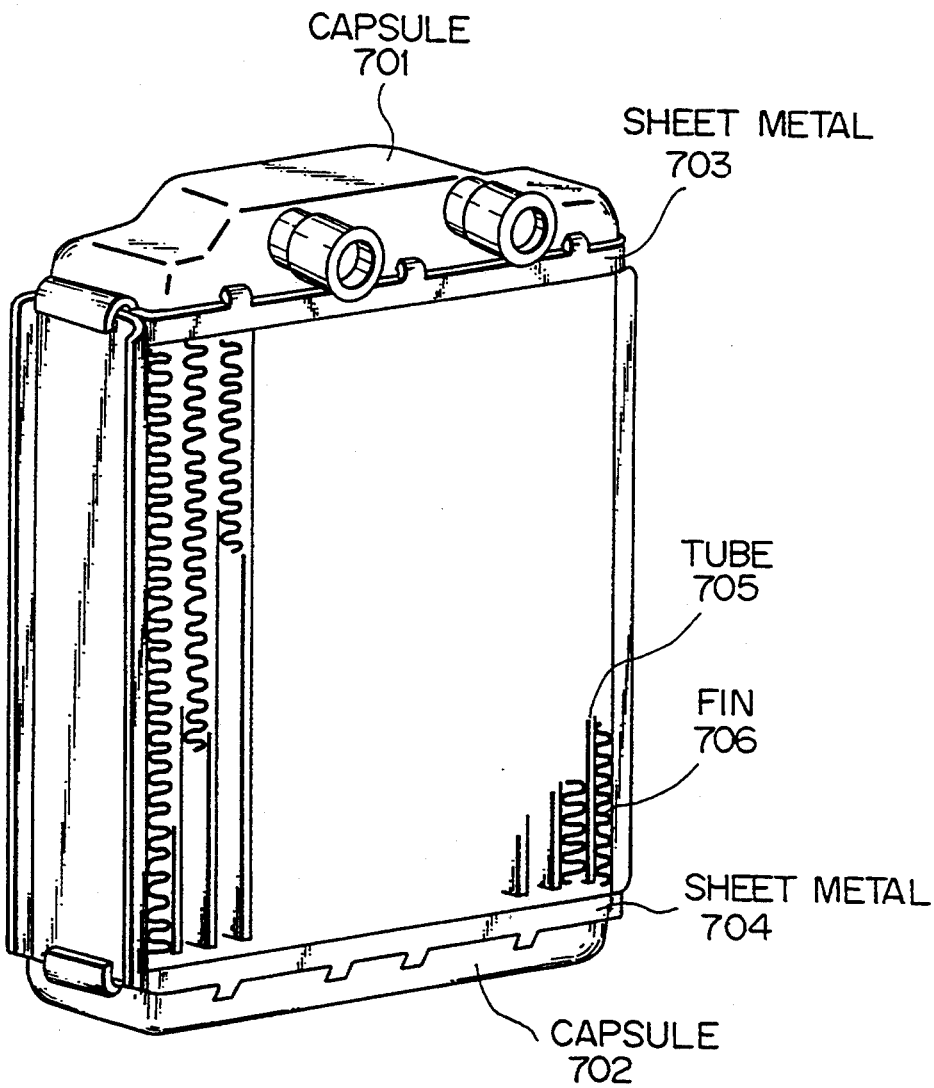
FIG. 2 shows a heater core of an automobile heater.

FIG. 2 shows a heater core of an automobile heater, that is composed of parts including capsules 701 and 702 at its top and bottom for storing a liquid medium circulating therethrough; vertically extending parallel tubes 705; corrugated fins 706 disposed between the tubes 705; and sheet metals 703 and 704 supporting the top and bottom ends of the tubes 705.

Figure 3A:
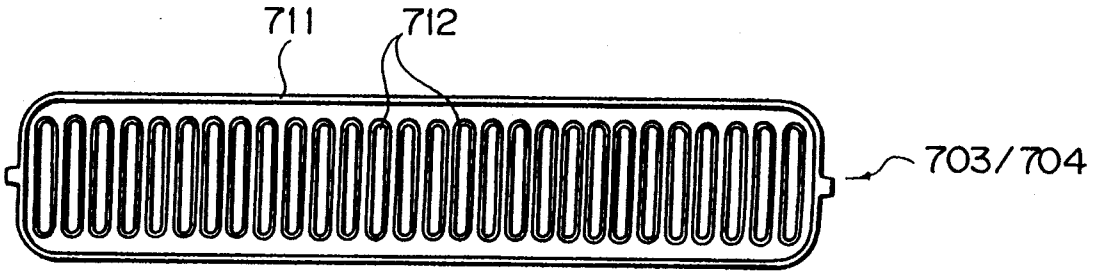
FIGS. 3A and 3B show a sheet metal advantageously produced according to the present invention, in plan and front views.
Figure 3B:
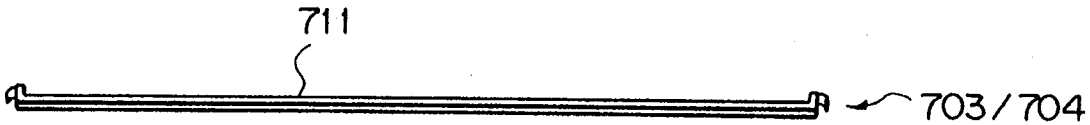

FIGS. 3A and 3B show, in plan and front views, the sheet metal 703 or 704 which can be advantageously produced by a process and apparatus according to the present invention. The shown sheet metal 703/704 has a shallow draw-formed brim 711 on the periphery and a plurality of evenly spaced oval holes 712 inside. The tubes 705 are inserted in the holes 712 and soldered.

Figure 4:
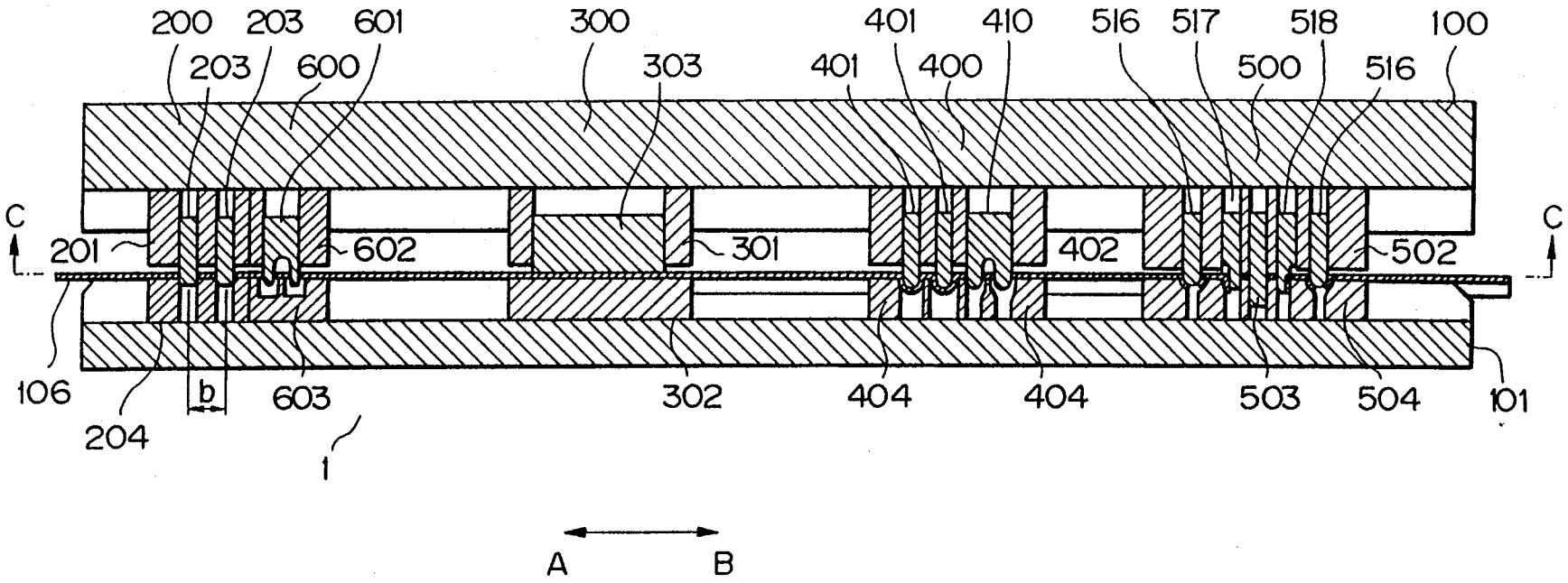
FIG. 4 shows the die assembly of a press forming apparatus according to the present invention, in a vertical, longitudinal section at the mid-width of the die assembly.
Figure 5:
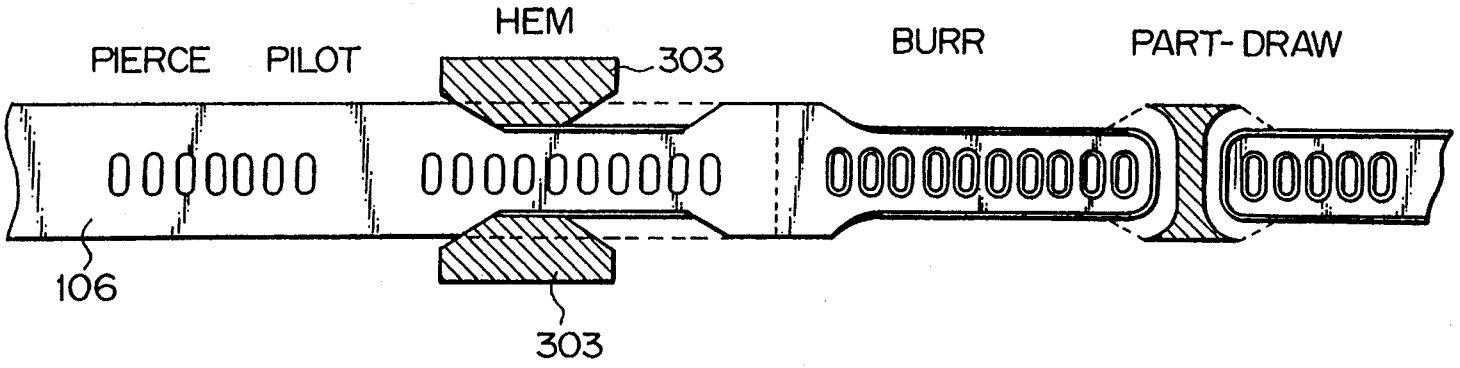
FIG. 5 shows a strip fed in the direction from left to right and being press-formed according to the present invention by the sequential process steps of piercing, piloting, hemming, burring and simultaneous parting and drawing, in a horizontal, longitudinal section.

FIG. 4 shows the die assembly of a press forming apparatus according to the present invention, in vertical, longitudinal section at the mid-width of the die assembly. FIG. 5 shows a strip fed in the direction from left to right and being press-formed by the sequential process steps of piercing, piloting, hemming, burring and simultaneous parting and drawing, in a horizontal, longitudinal section as denoted by the symbols "C" in FIG. 4.

The press forming apparatus 1 has upper and lower tables 100 and 101, on both of which punches and dies are mounted to effect the respective press forming steps. A not-shown strip feeder, placed on the left as directed by the arrow "A" in FIG. 4, supplies a strip 106 from a coil (not shown) to the press forming apparatus 1 at a constant feed in the longitudinal direction of the apparatus 1. The die assembly of the apparatus 1 is composed of separate stages of component dies and punches mounted on the upper and lower tables 100 and 101 and arranged in a line along the strip feeding direction in the order of a piercing stage 200 for piercing holes in the strip 106, a piloting stage 600 for piloting or positioning the strip, a hemming stage 300 for bending the side peripheries of the strip, a burring stage 400 for burring the pierced holes, and a parting and drawing stage 500 for simultaneously drawing both ends of a product and parting the product from the subsequent strip portion.

Thus, a strip 106 fed from the left (arrow "A") is press-formed through sequential forming stages in the press forming apparatus 1 to provide a press-formed product.

Thus, the apparatus 1 according to the present invention feeds a strip on the left (arrow "A"), press-forms the strip through the above-mentioned sequential stages, and discharges a product on the right (arrow "B").

The respective forming stages are composed as follows.

Piercing Stage

Figure 6A:
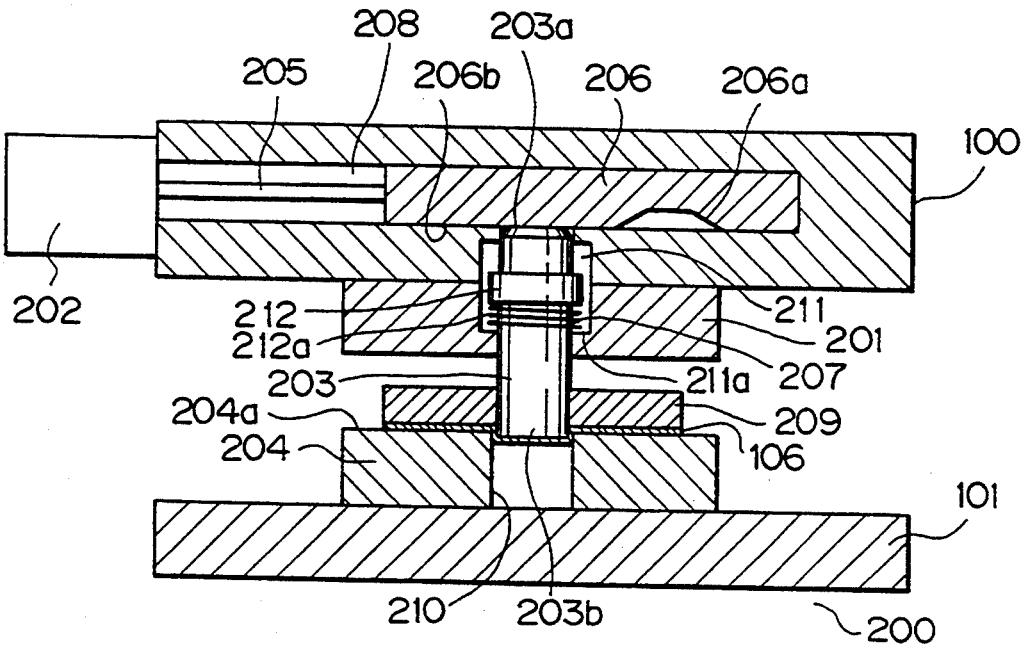
FIGS. 6A and 6B show, in a vertical, transverse section, a piercing stage according to the present invention, with an upper table lowered when piercing is (A) effected and (B) not effected, respectively.
Figure 6B:
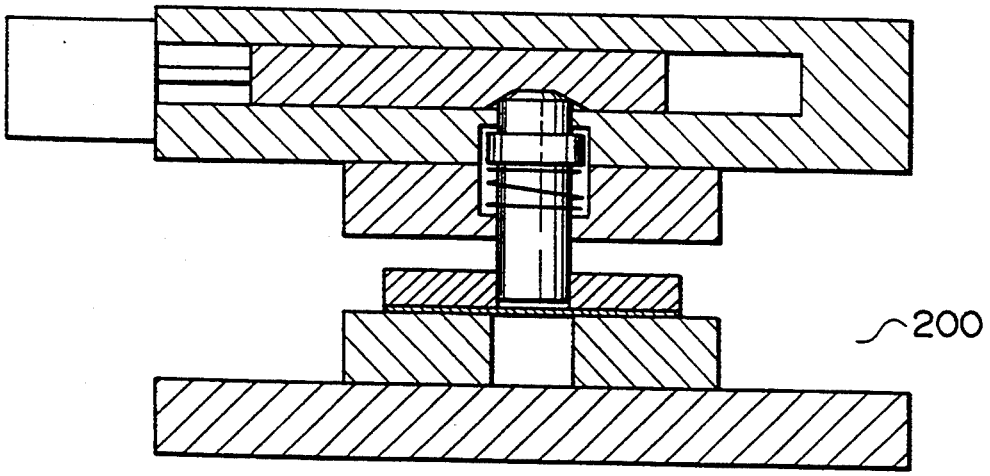

FIGS. 6A and 6B show, in a vertical, transverse section, the piercing stage 200 with the upper table 100 lowered when piercing is (A) effected and (B) not effected, respectively.

A punch base 201 is fixed to the upper table 100 on the strip feeding side (arrow "A" of FIG. 4). Two parallel punches 203 vertically extending through the base 201 are disposed at the mid-width of the base 201 spaced apart from each other at a distance "b" (FIG. 4) along the strip feeding direction. The punches 203 each has a lower end 203*b* having an oval cross section and extruding downward from the base 201 to pierce, at the mid-width of the strip 106, an oval hole with its major axis lying perpendicularly to the strip feeding direction. The punches 203 each has a trapezoidal upper end 203*a* forming a cam surface.

A die 204 fixed on the lower table 101 faces the punch base 201 and has, at the mid-width thereof, two oval holes 210 corresponding to and facing the lower ends 203*b* of the punches 203. A strip-pressing plate 209 is attached to the punch base 201 via a not-shown spring or other resilient members and lies above the die 204 to press downward and nip the strip 106 in cooperation with the upper surface 204*a* of the die 204 when the upper table 100 is lowered.

The punches 203 each has the following intermittent motion mechanism to temporarily intermit the piercing motion when the upper table 100 is lowered.

Above each of the punches 203, a square slide slot 203 is provided in the upper table 100 in the position corresponding to the punch 203 and extends in the direction perpendicular to the stroke axis of the punch 203. A cam rod 206 is inserted and engaged slidably in the slide slot 208. The cam rod 206 travels horizontally in the slot 208 by being driven by an air cylinder or other drive means connected thereto via a drive shaft 205 fixed to one end of the cam rod 206. The punch 203 is inserted in a hole 211 extending through the punch base 201 and the upper table 100 and communicating the slide slot 208 at the top end. The punch 203 has a stepped portion 212 in the middle, below which a coil spring 207 surrounds the punch 203. The upper and lower ends of the spring 207 abut against the lower surface 212*a* of the stepped portion 212 and the bottom rim 211*a* of the hole 211, respectively, to press the punch 203 upward by the resilient force of the spring 207 so that the upper surface 203*a* of the punch 203 abut against the cam rod 206 under pressure. The cam rod 206 has, in its lower surfacer a cam surface 206*a* in the form of a trapezoidal cavity or pit adapted to the cam surface 203*a* of the punch 203.

Pilot Stage

A pilot stage 600 is provided at the position next to the piercing stage 200 as shown in FIG. 4. The pilot stage 600 positions the strip 106 by inserting pilots in the holes formed in the previous piercing stage 200.

Figure 7A:
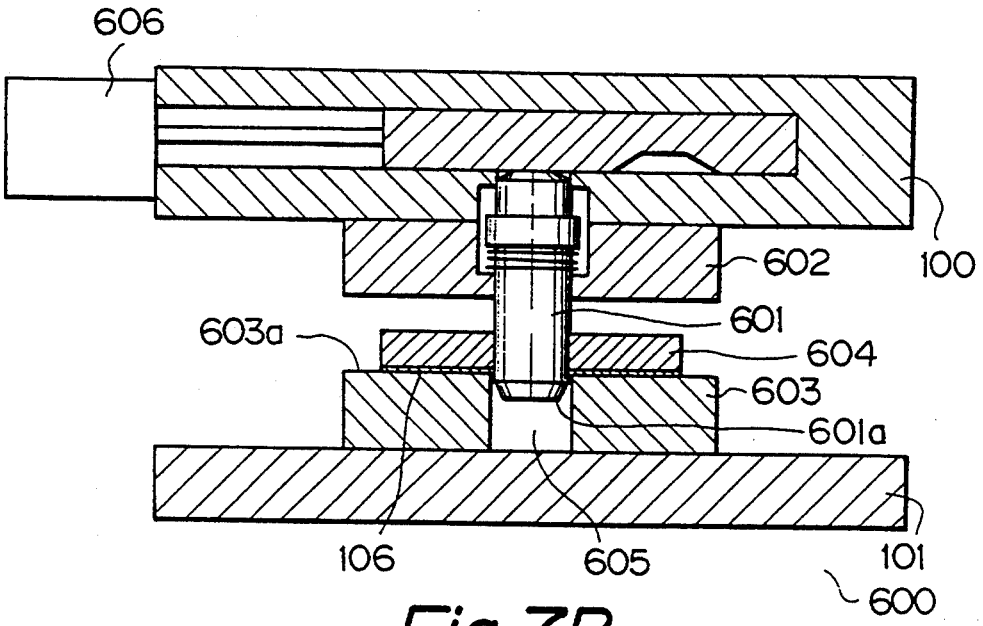
FIGS. 7A and 7B show, in a vertical, transverse section, a pilot stage according to the present invention, with an upper table lowered when piloting is (A) effected and (B) not effected, respectively.
Figure 7B:
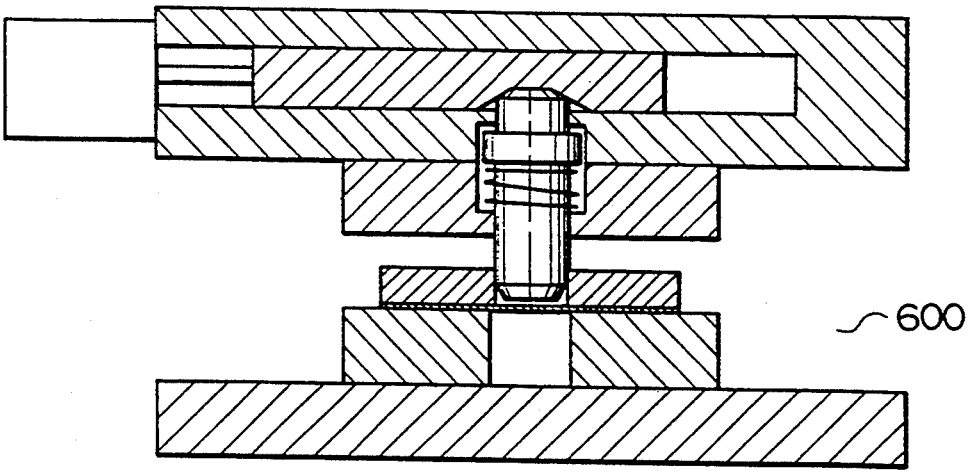

FIGS. 7A and 7B show, in a vertical, transverse section, a pilot stage 600 with the upper table 100 lowered when the piloting is (A) effected and (B) not effected, respectively.

A pilot base 602 is fixed to the upper table 100 on the right of the piercing stage 200. A vertically movable pilot 601 extends vertically through the pilot base 602 at the mid-width of the pilot base 602. The pilot 601 has a lower end 601*a* extruding downward from the pilot base 602; the lower end 601*a* has two parallel heads with an oval shape similar to that of the oval hole pierced in the preceding piercing stage 200; and the heads are spaced apart from each other at the same distance "b" as that between the punches 203 (FIG. 4). The heads of the pilot lower end 601*a* are usually smaller in diameter than the pierced hole by 3 to 5% of the strip thickness.

A die 603 fixed on the lower table 101 faces the pilot base 602 and has two parallel holes 605 greater in diameter than and facing the heads of the pilot lower end 601*a*. A strip-pressing plate 604 is attached to the pilot base 602 via a not-shown spring or other resilient member and lies above the die 603 to press downward and nip the strip 106 in cooperation with the upper surface 603*a* of the die 603 when the upper table 100 is lowered.

The pilot 601 has an intermittent motion mechanism, similar to that provided for the punches 203, to temporarily intermit the piloting motion when the upper table is lowered.

Intermittent motion is effected in the piercing stage 200 and the pilot stage 600 in the following manner.

When holes must be pierced in the strip in the piercing stage 200, the punch 203 is lowered or extrudes downward to its lowest position. This is achieved by operating the air cylinder 202 to move the cam rod 206 until its right end abuts on the right end of the slide slot 208 so that the upper end 203*a* of the punch 203 abuts against the slide surface 206*b* of the cam rod 206 thereby forcing the punch 203 to extrude downward while restraining the punch 203 from moving upward, i.e., the punch 203 is positioned for effecting piercing a hole.

The upper table 100 is then moved upward or regresses to its uppermost position by a known drive means, so that the die is open. The strip 106 is fed from a strip feeder and is inserted between the die 204 and the strip pressing plate 209.

As the upper table 100 is moved downward, the strip pressing plate 209 first presses the strip 106 so that the strip 106 is nipped between the upper surface 204*a* of the die 204 and the plate 209. The upper table 100 is further lowered to contract a spring or other resilient member inserted between the punch base 201 and the pressing plate 209, so that the lower end 203*a* of the punch 203 comes into contact with the strip 106, passes downward the level of the upper surface 204*a* of the die 204 and intrudes in the hole 210 of the die 204 to pierce a hole through the thickness of the strip 106.

The upper table 100 is returned to its uppermost position, lifting the punch base 201 together with the strip pressing plate 209 to release the strip 106.

In this piercing stage, two oval holes are simultaneously formed by two punches 203.

To pierce additional neighboring holes sequentially at the same interval as that of the above-formed holes, an additional feed of the strip 106 is supplied from the strip feeder at a pitch of two times the distance "b" between the holes. This positions the first pierced holes right below the heads of the lower end 601*a* of the pilot 601. Additional neighboring holes are pierced in the piercing stage 200 with the strip 106 positioned by the pilot 601 of the pilot stage 600. This is achieved by moving the cam rod by the air cylinder 606 to lower the pilot to its lower position in the same manner as in the piercing punches 203, except that the lower end 601*a* of the pilot 601 extrudes downward slightly more than the lower end 203*a* of the piercing punch 203. Under this condition, when the upper table 100 is lowered for effecting the piercing, the heads of the lower end 601*a* of the pilot 601 are inserted in the previously pierced holes to position the strip 106 before the lower end 203*a* of the punch 203 comes into contact with the strip 106, so that additional neighboring holes can be pierced at accurately the same interval without deflection of the strip 106. This piercing motion does not cause the surrounding material to be undesirably deformed due to dragging by the pierced portion.

Further additional holes may be pierced sequentially at a constant interval "b", by repeating the above-described operation by feeding the strip 106 at a constant pitch of two times the interval "b".

Hemming Stage

The strip 106 next enters the hemming stage 300, in which the strip 106 is subjected to downward bending of the side peripheries over a length along the feeding direction.

Figure 8A:
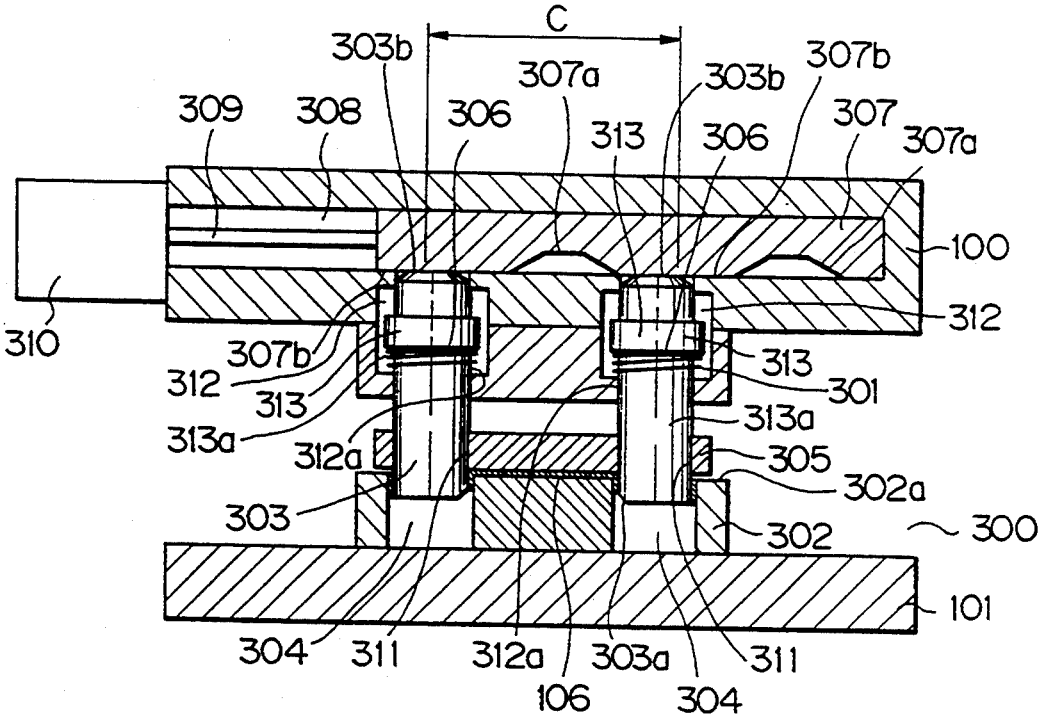
FIGS. 8A and 8B show, in a vertical, transverse section, a hemming stage according to the present invention, with an upper table lowered when hemming is (A) effected and (B) not effected, respectively.
Figure 8B:
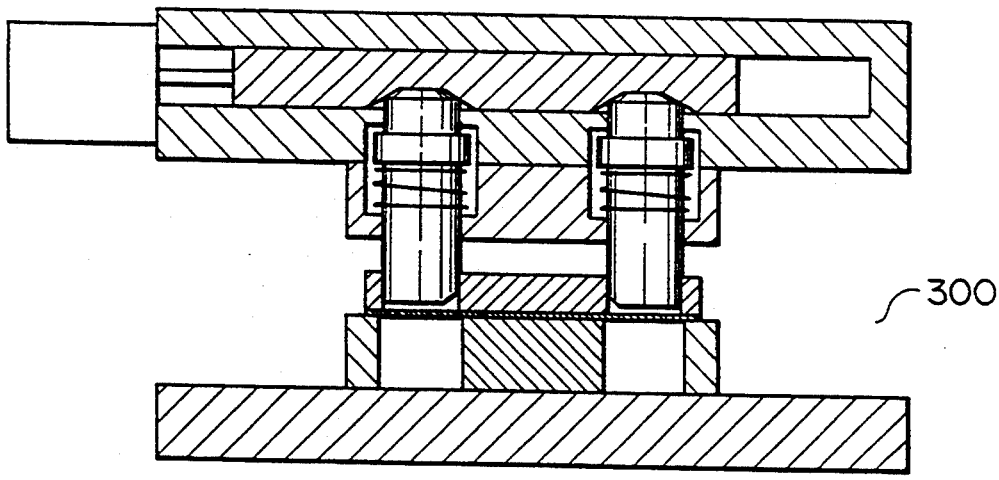

FIGS. 8A and 8B show, in a vertical, transverse section, a hemming stage 300 with the upper table 100 lowered when the hemming motion is (A) effected and (B) not effected, respectively.

A bending or hemming punch base 301 is provided on the upper table 100 on the right of the pilot base 600 (FIG. 4). A pair of hemming punches 303 vertically extend through the hemming punch base 301 and are disposed symmetrically about the strip axis and apart from each other at a distance "c". The hemming punches 303 are each positioned so that the lower portion of the punches extrude downward from the punch base 301.

A die 302 fixed on the lower table 101 faces the hemming punch base 301 and has a pair of holes 304 disposed facing the hemming punches 303 and accommodating the latter. A strip-pressing plate 305 is attached to the hemming punch base 301 via a not-shown spring or other resilient member and lies above the die 302 to press downward and nip the strip 106 in cooperation with the upper surface 302*a* of the die 302 when the upper table 100 is lowered. The strip-pressing plate 305 has a pair of holes 311 through which the hemming punches 303 pass. The hemming punches 303 each has a trapezoidal cam surface 303*b* on the top end.

The hemming punches 303 each has an intermittent motion mechanism to temporarily intermit the hemming motion when the upper table 100 is lowered.

Above each of the hemming punches 303, a square slide slot 308 is provided in the upper table 100. A cam rod 307 is inserted and engaged slidably in the slide slot 208. The cam rod 307 travels horizontally in the slide slot 308 by being driven by an air cylinder or other drive means 310 connected thereto via a drive shaft 309 fixed to one end of the cam rod 307. A hole 312 communicates with the slide slot 308, allowing the cam surface 303*b* provided on the upper end of the hemming punch 303 to engage the cam rod 307. The punch 303 has a stepped portion 313 in the middle, below which a coil spring 306 surrounds the punch 303. The upper and lower ends of the spring 306 abut against the lower surface 313*a* of the stepped portion 313 and the bottom rim 312*a* of the hole 312, respectively, to press the punch 303 upward by the resilient force of the spring 306 so that the upper surface 303*b* of the punch 303 abuts against the cam rod 307 under pressure. The cam rod 307 has a pair of cam surfaces 307*a* in the form of a trapezoidal cavity or pit adapted to the cam surfaces 303*b* of the punches 303 and spaced apart from each other at the same distance "c" as that between the punches 303.

To effect hemming in the thus-composed hemming stage 300, the hemming punches 303 are positioned extruded downward. This is achieved by operating the air cylinder 310 to move the cam rod 307 until the latter abuts the right end of the slide slot 308, so that the lower surface 307*b* of the cam rod 307 abuts the upper ends 303*b* of the punches 303 thereby keeping the punches extruded downward.

The upper table 100 is then moved upward to its uppermost or waiting position. The strip 106 is fed from the strip feeder so that the pierced portion of the strip 106 is inserted between the die 302 and the strip-pressing plate 305 of the hemming stage 300.

As the upper table 100 is moved downward by a known drive means, the strip-pressing plate 305 first presses the strip 106 so that the strip 106 is nipped between the upper surface 302*a* of the die 302 and the plate 305. The upper table 100 is further lowered to contract the spring or other resilient member inserted between the punch base 301 and the plate 305. Because a clearance is provided between the hemming punches 303 and the die 302, the punches first comes into contact with the strip 106 and then passes downward the level of the upper surface 302*a* of the die 302 to bend downward the both side peripheries of the strip following the profile of the die 302 over a length of the strip.

The desired portion of the pierced strip can be subjected to the hemming process by controlling the strip feed and judging the strip position, based on a known numerical control system. This control may include positioning of the strip by the pilot 601 of the preceding pilot stage 600.

When the upper table 100 is lowered to effect the hemming in the stage 300, the piercing punches 203 in the piercing stage 200 are also lowered together with the table 100, with the result that the strip portion positioned under the piercing punches 203 is subjected to piercing, even if that portion must not be pierced. Therefore, when this portion is not to be pierced, the piercing punches 203 must be temporarily regressed or moved upward by operating the intermittent motion mechanism to avoid piercing such a portion. This is achieved by operating the air cylinder 202 to move the cam rod 206 until the cam surfaces 206*a* face the upper ends or cam surfaces 203*a* of the piercing punches 203, so that the trapezoidal cam surfaces 203*a* are raised until they are brought into engagement with the cam surfaces 206*a* in the form of a trapezoidal cavity or pit of the cam rod 206 by the resilient force of the spring 207. When the piercing punches 203 are thus regressed or moved upward to the uppermost position, the lower ends 203*b* of the piercing punches 203 do not reach the strip 106 to avoid the above-mentioned undesired piercing when the upper table 100 is moved down to its lowermost position.

In the same manner, hemming of the undesired strip portion can be also avoided or omitted in the hemming stage 300 while other press-forming operations are effected in other stages, by making the hemming punches 303 regress upward by operating the air cylinder 310. This is achieved by the same procedure as that described above and further explanation is not repeated.

Burring Stage

The strip 106 next enters a burring stage 400, in which the pierced hole is subjected to stretch-flanging process to form a columnar flange entirely over the hole periphery.

Figure 9A:
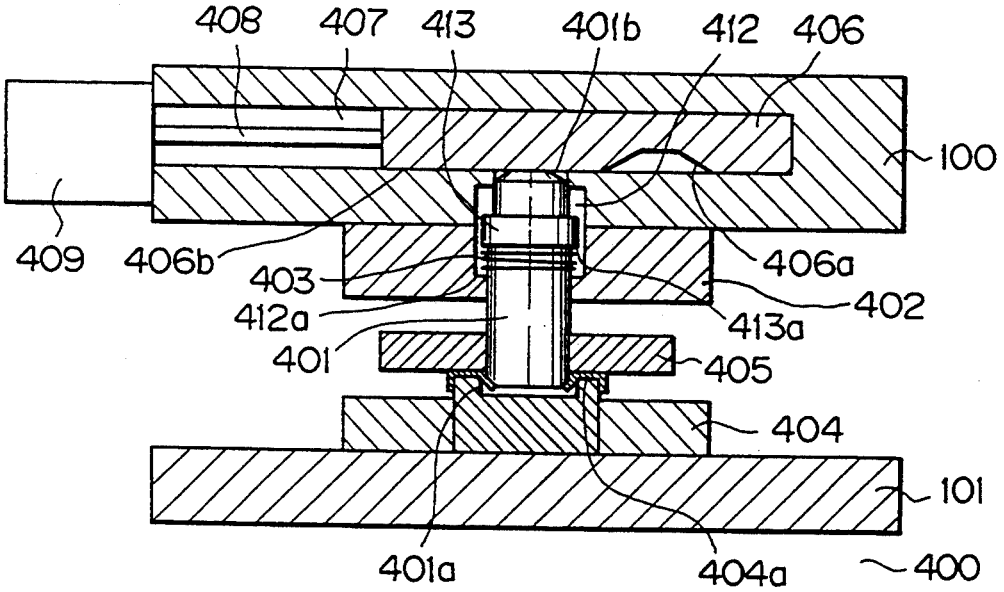
FIGS. 9A and 9B show in a vertical, transverse section, a burring stage according to the present invention, with an upper table lowered when burring is (A) effected and (B) not effected, respectively.
Figure 9B:
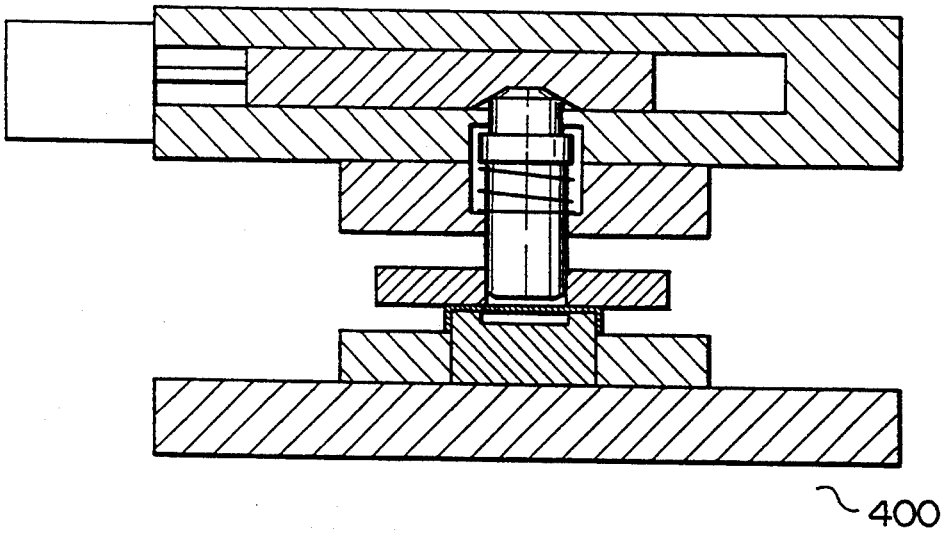

FIGS. 9A and 9B show a burring stage with the upper table 100 lowered when the burring motion is (A) effected and (B) not effected, respectively, in a vertical, transverse section.

A burring punch base 402 is fixed to the upper table 100 on the right of the hemming stage 300 (FIG. 4). Two parallel vertically movable burring punches 401 vertically extend through the base 402 at the mid-width of the base 402 and are spaced apart from each other at the same distance "b" as that between the piercing punches 203, along the strip feeding direction. The burring punches 401 are positioned so that the lower portions extrude downward from the burring punch base 402. The burring punch 401 has a lower end 401*a* greater in diameter than the pierced holes so as to effect the stretch-flanging of the hole periphery.

A die 404 fixed on the lower table 101 faces the burring punch base 402 and has, in the mid-width portion thereof, two concavities disposed facing the burring punches 401, respectively. The upper surface of the die 404 has a stepped portion such that the hemmed peripheries of the strip 106 do not contact the upper surface of the die 404. A strip-pressing plate 405 is attached to the burring punch base 402 via a not-shown spring or other resilient member and lies above the die 404 to press downward and nip the strip 106 in cooperation with the upper surface 404*a* of the die 404 when the upper table 100 is lowered. The each burring punch 401 has a trapezoidal cam surface 401*b* on the top end.

The burring punches 401 each has the following intermittent motion mechanism to temporarily intermit the burring action when the upper table 100 is lowered.

Above each of the burring punches 401, a square slide slot 407 is provided in the upper table 100. A cam rod 406 is inserted and engaged slidably in the slide slot 407. The cam rod 406 travels horizontally in the slide slot 407 by being driven by an air cylinder or other drive means 409 connected thereto via a drive shaft 408 fixed to one end of the cam rod 406. A hole 412 communicates with the slide slot 407, allowing the trapezoidal cam surface 401*b* to engage the cam rod 406. The punch 401 has a stepped portion 413 in the middle, below which a coil spring 403 surrounds the punch 401. The upper and lower ends of the spring 403 abut against the lower surface 413*a* of the stepped portion 413 and the bottom rim 412*a* of the hole 412, respectively, to press the punch 401 upward by the resilient force of the spring 403 so that the upper surface 401*b* of the punch 401 abut against the cam rod 406 under pressure. The cam rod 406 has a cam surface 406*a* in the form of a trapezoidal cavity or pit 10 adapted to the cam surface 401*b* of the punch 401.

As shown in FIG. 4, a deformation-preventing pilot 410 is disposed next to the burring punches 401. The deformation-preventing pilot 410 has a construction similar to that of the pilot stage 600, so that the heads of the lower end of the pilot 410 are inserted in the burred holes. An intermittent motion mechanism is provided to temporarily prevent the pilot 410 from being inserted in the holes when the upper table 100 is lowered.

To effect burring in the thus-composed burring stage 400, the burring punches 401 are lowered to an extruded position. This is achieved by operating the air cylinder 409 to move the cam rod 406 until the latter abuts the right end of the slide slot 407, so that the lower surface 406*b* of the cam rod 406 abuts the upper ends 401*b* of the punches 401 thereby keeping the punches extruded downward.

The upper table 100 is then moved upward to its uppermost position for waiting. The strip 106 is fed from the strip feeder so that the pierced and hemmed portion of the strip 106 is inserted between the die 404 and the strip-pressing plate 405 of the burring stage 400.

As the upper table 100 is moved downward by a known drive means, the strip-pressing plate 405 first presses the strip 106 so that the strip 106 is nipped between the upper surface 404*a* of the die 404 and the plate 405. The upper table 100 is further lowered to contract the spring or other resilient member inserted between the burring punch base 402 and the plate 405. Because the burring punches 401 have lower ends greater in diameter than the pierced holes, the punches 401 progress downward pressing and bending the hole peripheries to effect burring.

To effect burring the neighboring holes pierced at the same interval, an additional feed of the strip 106 is supplied from the strip feeder at a pitch of twice the distance "b" between the pierced holes, so that the two first burred holes are positioned just below the deformation-preventing pilot 410. The thus-positioned strip 106 is subjected to burring of the neighboring holes, with the deformation preventing pilot 410 kept in the extruded position. The deformation-preventing pilot 410 is brought into its extruded position in the same manner as that used to extrude the piercing punches 203, except that the lower end of the pilot 410 extrudes downward slightly below the lower end 410*a* of the burring punches 401. Under this condition, when the upper table 100 is lowered for effecting the burring, the heads of the pilot 410 are inserted in the previously burred holes to position the strip 106 before the lower end 401*a* of the punch 401 comes into contact with the strip 106, so that additional neighboring holes can be burred without undesired deformation of the burred holes and without deflection of the strip 106. Holes formed at the same interval are burred by repeating the above-mentioned procedure.

When the upper table 100 is lowered to effect burring, the piercing punches 203 and the hemming punches 303 are also lowered together with the table 100. To avoid undesired piercing or hemming of the specific strip portion, the punches are regressed or moved upward by means of the intermittent motion mechanisms in the corresponding stages, respectively.

Parting/Drawing Stage

The strip 106 next enters a parting and drawing stage 500.

As shown in FIG. 4, a parting and drawing punch base 502 is fixed on the upper table 100 on the right of the burring stage 400. The punch base 502 has a parting punch 503 in the mid-width thereof vertically extending therethrough, that can vertically extrude and regress to part the strip 106. Upstream and downstream of the parting punch 503 with respect to the strip feeding direction, drawing punches 517 and 518 vertically extend through the base 502, that can vertically extrude and regress to draw-form both ends of a parted piece of the strip 106. The punches 517 and 518 draw-form the left and right ends of the final product, respectively, and are disposed symmetrically about the parting punch 503. Upstream and downstream of the punches 517 and 518, deformation-preventing pilots 516 are disposed extending vertically through the punch base 502, that can vertically extrude and regress. The pilots 516 have heads having shapes adapted to insertion into the burred holes.

Figure 10A:
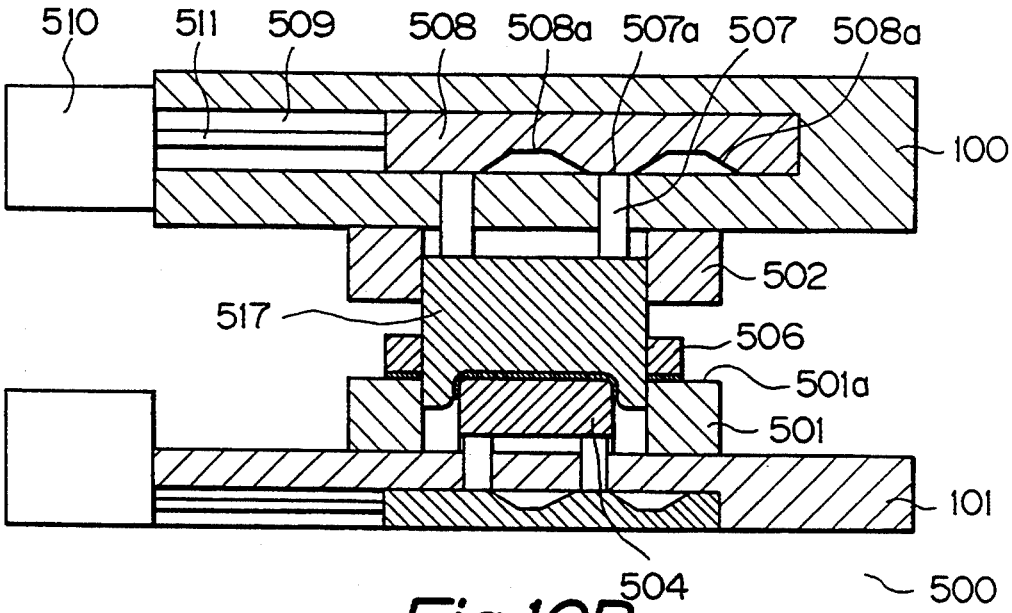
FIGS. 10A and 10B show, in a vertical, transverse section, a parting and drawing stage according to the present invention, with an upper table lowered when parting and drawing are (A) effected and (B) not effected, respectively.
Figure 10B:
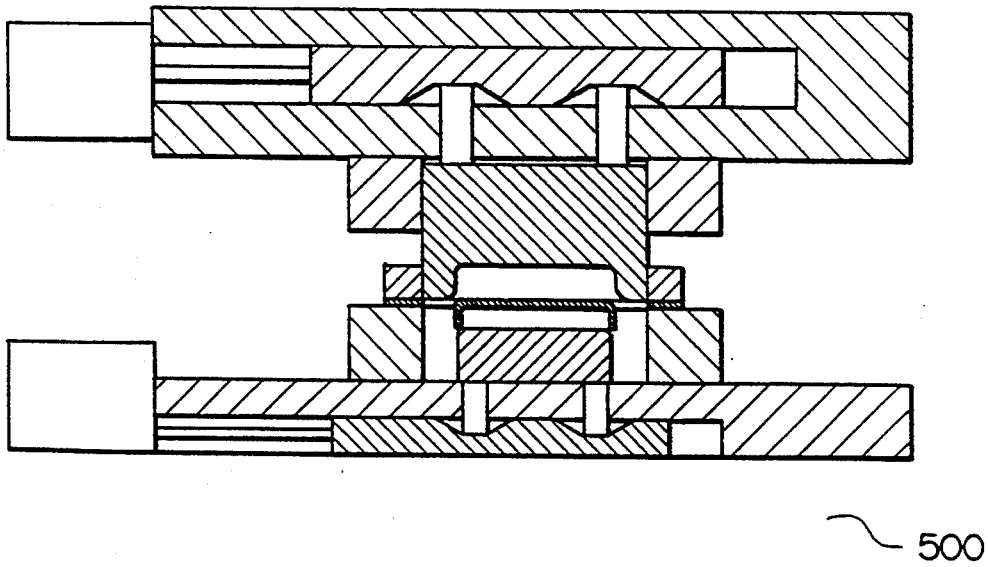

FIGS. 10A and 10B show, in a vertical, transverse section, the parting and drawing stage 500 with the upper table 100 lowered when the parting and drawing is (A) effected and (B) not effected, respectively.

Above each of the drawing punches 517 and 518, a slide slot 509 is provided in the upper table 100, with the slot axis extending horizontally or perpendicularly to the stroke direction of the punches 517 and 518. A cam rod 508 is inserted and engaged slidably in the slide slot 509. The cam rod 508 travels horizontally in the slide slot 509 by being driven by an air cylinder or other drive means 510 connected thereto via a drive shaft 511 fixed to one end of the cam rod 508. The drawing punch 517 has, on the top, vertically extending rods 507 having top ends 507*a* abutting on the cam rod 508. Each of the rods 507 has a not-shown mechanism to press the punch 517 upward by a resilient force of a spring or the like, similar to that for pressing the burring punch 401 upward in the burring stage 400. The cam rod 508 has two cam surfaces 508*a* in the form of a trapezoidal cavity or pit.

A die 501 is mounted on the lower table 101 and contains dies 504 which face the punches 517 and 518, respectively and are able to vertically extrude and regress. The dies 504 extrude and regress, by a mechanism similar to that of the punch 517, over a distance corresponding to the height to which the strip 106 is draw-formed in the both ends. A strip-pressing plate 506 is attached to the punch base 502 via a spring or other resilient member and lies above the die 501 to press downward and nip the strip 106 in cooperation with the upper surface 501*a* of the die 501 when the upper table 100 is lowered.

To effect parting and drawing in the stage 500 composed as mentioned above, the punches 503, 517 and 518 are downward extruded and the die 504 is upward extruded by the respective intermittent motion mechanisms.

The upper table 100 is then moved upward to its uppermost or waiting position. An additional feed of the strip 106 is supplied from the strip feeder so that the pierced, hemmed and burred portion of the strip is inserted between the dies 501 and 504 and the strip-pressing plate 506.

As the upper table 100 is mowed downward by a known drive means, the strip-pressing plate 506 first presses the strip 106 so that the strip 106 is nipped between the upper surface 501*a* of the die 501 and the plate 506. The upper table 100 is lowered to contract the spring or other resilient member inserted between the punch base 502 and the plate 506. Because they extrude downward more than the heads of the drawing punch 517 and the parting punch 503, the heads of the deformation-preventing pilot 516 are first inserted into the burred holes positioned below the deformation-preventing pilot 516. Thereafter, the heads of the parting punch 503, extruding downward more than the heads of the drawing punch 517, are brought into contact with the strip 106 to cut or part the latter. The thus-parted portion of the strip 106 is draw-formed in its both ends by the punches 517 and 518. The strip is positioned and held by the deformation-preventing pilots 516 on both ends to prevent undesired deflection and deformation of the strip 106 during draw-forming.

After the upper table 100 is lowered to its lowest position to complete the necessary forming process, the upper table is returned to its uppermost position.

An additional feed of the strip 106 is then supplied from the strip feeder to discharge the complete product through the right end of the parting and drawing stage 500. Upon this discharge, the die 504 is downward regressed by the aforementioned extrusion and regression mechanism so that both ends of the draw-formed product do not interfere with the die 504 when the additional feed of the strip is supplied.

To avoid the parting and drawing motion during other forming motions, the punches of the parting and drawing stage 500 are regressed by the respective intermittent motion mechanisms.

According to the present inventive press forming apparatus composed of different press forming stages such as exemplified above, the respective intermittent motion mechanisms are controlled in cooperation with the control of the strip feeder, and thereby, press-formed products can be produced with arbitrary lengths and number of pierced holes. When piercing is not necessary, the apparatus may be composed only of a hemming stage and a parting and drawing stage. The number of the piercing punches is not limited to two but may be any number including one, so long as correspondence with the feed control for other forming stages is ensured. The number of the heads of the pilot punch 601 is not limited to two but may be any number including one. This also applies in the burring punch 401 and the deformation-preventing punches 410 and 516.

The drive means of the intermittent motion mechanisms of the respective forming stages are not limited to air cylinders but may be electromagnetic solenoids, hydraulic cylinders, or any other means generating a driving force.

Figure 11:
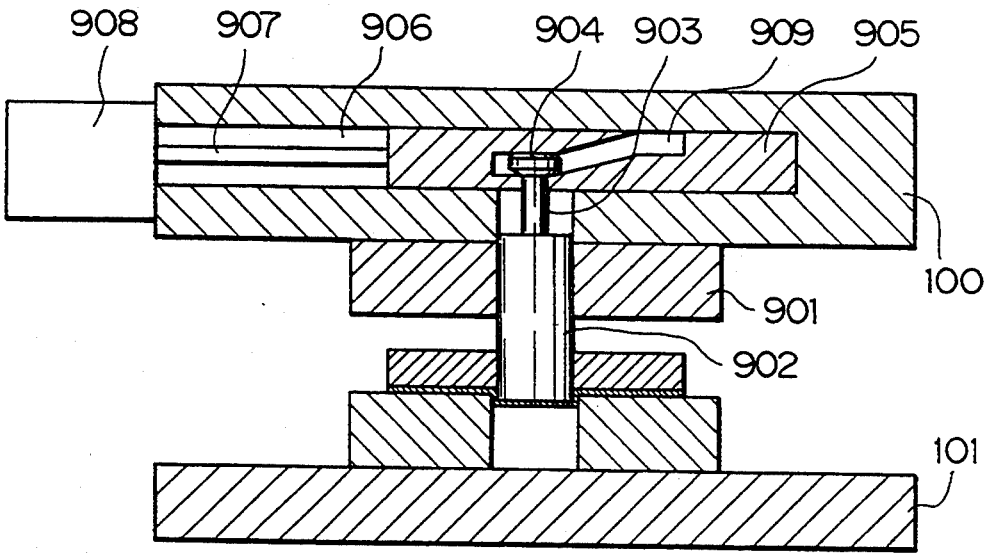
FIG. 11 shows another embodiment of the cam structure of the intermittent motion mechanism according to the present invention, in a vertical, transverse section.

The cam structure of the intermittent motion mechanism is not limited to that described in this example but may be composed in other manners, such as shown in FIG. 11. A punch 902 extends through a punch base 901, can vertically extrude and regress and has, on the top, a member 903 having, on the top end, a cylindrical slide member 904 greater in diameter than the member 903. An upper table 100 has a slide slot 904 formed therein above the punch 902. A cam rod 905 slides and travels horizontally in the slide slot 906. The cam rod 905 has a cam groove 909 formed therein and composed of two horizontal portions located on different levels and a slope portion connecting the horizontal portions. The cylindrical slide member 904 is inserted in the cam groove 909.

In this cam structure, the air cylinder 908 drives the cam rod 705 leftward to shift the slide member 904 from lower to higher levels of the horizontal groove portions through the slope portion. The punch 902 is raised or regresses upward, together with the member 903, by this upward shift of the member 904. Inversely, the punch 902 is lowered, or extrudes downward, by driving the cam rod 905 rightward to cause the slide member 904 to shift from the higher to the lower level through the cam groove 909.

Instead of a spring or other resilient member, the regression motion of the punches may be achieved by other drive means including an air cylinder used as a drive means for the cam rods. The intermittent motion may be achieved by hand operation when temporarily necessary.

Although this example demonstrates an embodiment in which the product length is varied, the present invention also applicable when the product width is varied, by shifting the punches and dies widthwise in the hemming stage within the range allowable for the strip width and the process parameters in other forming stages.

As hereinabove-described, the present invention provides a press-forming process and an apparatus for carrying out the process, in which the provision of an intermittent motion mechanism to avoid a specific unnecessary or undesired forming stage and products having arbitrary different dimensions can be press-formed without changing dies, thereby improving the press forming operation including a reduced cost for making dies and the lack of setup time needed for changing dies.

We claim:

1. A process of press-forming a strip fed in its longitudinal direction to continuously produce press-formed articles with arbitrary lengths and to perform different forming steps, in a single die, the forming steps including a draw-forming step, said process comprises in sequence:

a first step of continuously forming a semi-finished product having a middle portion formed over a length corresponding to that of a final product;

a second step of forming an unformed leading end connected to an unformed following end of a neighboring antecedent semi-finished product by preventing performance of said first step and, while feeding a strip in the direction of the strip length at a selected pitch;

a third step of simultaneously draw-forming said unformed leading end of said semi-finished product and said unformed following end of said neighboring antecedent semi-finished product to a selected shape, said ends being connected to the respective semi-finished products;

a fourth step of preventing performance of said third step;

a fifth step of separating scrap from peripheries of said leading end of said semi-finished product and said following end of said neighboring antecedent semi-finished product; and a sixth step of preventing performance of said fifth step.

2. An apparatus for press-forming a strip fed in its longitudinal direction to continuously produce press-formed articles with arbitrary lengths, said apparatus comprising:

means for feeding a strip in the direction of the strip length at a selected pitch;

first press-forming means for continuously forming a semi-finished product having a middle portion formed over a length corresponding to that of a final product, and having a first intermittent motion mechanism for intermitting the press-forming motion of said press-forming means for arbitrary time interval to form an unformed leading end connected to an unformed following end of a neighboring antecedent semi-finished product, while said feeding means feeds a strip in the direction of the strip length at a selected pitch;

a second press-forming means for simultaneously draw-forming said unformed leading end of said semi-finished product and said unformed following end of said neighboring antecedent semi-finished product to a selected shape, and having a second intermittent motion mechanism for intermitting the press-forming motion of said second press-forming means, said ends being connected to the respective semi-finished products; and a third press-forming means for separating scrap from peripheries of said leading end of said semi-finished product and said following end of said neighboring antecedent semi-finished product, and having a third intermittent motion mechanism for intermitting the press-forming motion of said third press-forming means, so that by intermitting said press-forming motions during arbitrary pitches, said middle portion of the strip is press-formed over a length corresponding to said pitch, said unformed leading and following ends of said semi-finished products are draw-formed to a selected shape connected to said middle portion and separated to form a final product with an arbitrary length.

3. An apparatus according to claim 2, wherein said second press-forming means and said third press-forming means compose a fourth single press-forming means for effecting said draw-forming and said separating.

4. An apparatus according to claim 3, wherein said first press-forming means includes a pilot means for accurately positioning the strip by utilizing the portions press-formed by the first press-forming means so that said middle portion of the strip is press-formed at a selected pitch.

5. An apparatus according to claim 4, wherein said fourth press-forming means includes a pilot means for accurately positioning the strip by utilizing the portions press-formed by the first press-forming means so that said drawing and said separation are effected by said fourth press-forming means at a selected pitch.

6. An apparatus for press-forming a strip fed in its longitudinal direction to continuously produce press-formed articles with arbitrary lengths through forming stages including a draw-forming stage, said apparatus comprising:

a first table on which are provided a plurality of press-forming means including a first press-forming means for continuously forming a semi-finished product having a middle portion formed over a length corresponding to that of a final product and an unformed leading end connected to an unformed following end of a neighboring antecedent semi-finished product, while feeding a strip in the direction of the strip length at a selected pitch; and disposed downstream of said first press-forming means, a second press-forming means for simultaneously draw-forming said unformed leading end of said semi-finished product and said unformed following end of said neighboring antecedent semi-finished product to a selected shape, said ends being connected to the respective semi-finished products, and said plurality of press-forming means having individual intermittent motion mechanisms to intermit their press-forming motions for arbitrary time intervals, respectively;

a second table on which are provided press-forming means corresponding to, and engageable with, said press-forming means on said first table;

means for feeding the strip between said first table and said second table at a selected feeding pitch; and drive means for raising and lowering said first table interlocking with said feeding pitch to effect press-forming by the engagement between press-forming means on said first and second tables as said first table is lowered, so as to repeat a cycle composed of the phases of feeding the strip by one pitch when the first table is raised end effecting said press-formings when said first table is lowered so that, by intermitting said press-forming motions at arbitrary pitches, said middle portion of the strip is press-formed over a length corresponding to the pitch and, corresponding to said pitch, said unformed leading and following ends of said semi-finished products are draw-formed to a selected shape connected to said middle portion and separated to form a final product with an arbitrary length.

7. An apparatus according to claim 6, wherein said plurality of press-forming means include a pilot means for accurately positioning the strip by utilizing the portions press-formed by the first press-forming means so that said middle portion of the strip is press-formed at a selected pitch.

8. An apparatus according to claim 7, wherein said plurality of press-forming means are dies or punches.

9. An apparatus according to claim 6, wherein said first and second tables are provided with a means for separating scrap from peripheries of said leading end of said semi-finished product and said following end of said antecedent semi-finished product.

10. An apparatus for press-forming a strip fed in its longitudinal direction between two tables to continuously produce press-formed articles with arbitrary lengths by changing a setting of said apparatus corresponding to a press-forming products and to perform different forming stages at one engagement of said two tables, said apparatus comprising:

a plurality of press-forming means for performing different press-forming operations disposed between said two tables;

means for feeding the strip to said plurality of press-forming means between said two tables, wherein each of said plurality of press-forming means has an intermittent motion mechanism to intermit its press-forming motion for an arbitrary time interval, so that said strip is press-formed with an arbitrary length corresponding to said arbitrary time interval and said apparatus can produce press-formed articles by varying said arbitrary time interval; and means for draw-forming said strip which is pressed formed by said plurality of press-forming means.

* * * * *